US009175469B2

(12) United States Patent
Toopchinezhad et al.

(10) Patent No.: US 9,175,469 B2
(45) Date of Patent: Nov. 3, 2015

(54) SELF-REINFORCED MASONRY BLOCKS, WALLS MADE FROM SELF-REINFORCED MASONRY BLOCKS, AND METHOD FOR MAKING SELF-REINFORCED MASONRY BLOCKS

(75) Inventors: Hamid Toopchinezhad, Hamilton (CA); Robert Drysdale, Ancaster (CA); Michael Tait, Dundas (CA)

(73) Assignee: MCMASTER UNIVERSITY, Hamilton, Ontario (CA)

( * ) Notice: Subject to any disclaimer, the term of this patent is extended or adjusted under 35 U.S.C. 154(b) by 0 days.

(21) Appl. No.: 13/824,071

(22) PCT Filed: Sep. 14, 2011

(86) PCT No.: PCT/CA2011/001043

§ 371 (c)(1),
(2), (4) Date: Jun. 6, 2013

(87) PCT Pub. No.: WO2012/034224

PCT Pub. Date: Mar. 22, 2012

(65) Prior Publication Data

US 2013/0247497 A1 Sep. 26, 2013

Related U.S. Application Data

(60) Provisional application No. 61/382,964, filed on Sep. 15, 2010.

(51) Int. Cl.
*E04B 2/26* (2006.01)
*B28B 1/08* (2006.01)
(Continued)

(52) U.S. Cl.
CPC ... *E04B 2/26* (2013.01); *B28B 1/08* (2013.01); *B28B 7/183* (2013.01); *B28B 23/02* (2013.01)

(58) Field of Classification Search
CPC ..... B28B 1/08; B28B 23/02; B28B 7/183; E04B 2/26
USPC ..... 52/565, 606
See application file for complete search history.

(56) References Cited

U.S. PATENT DOCUMENTS 786,884 A * 4/1905 Faulkner ..... 52/289
980,479 A * 1/1911 Bishop ..... 138/143
(Continued)

FOREIGN PATENT DOCUMENTS

CA 2 503 234 A1 10/2005
WO WO 2006/020261 A2 2/2006

OTHER PUBLICATIONS

Hart et al.; The Use of Confinement Steel to Increase the Ductility in Reinforced Concrete Masonry Shear Walls; TMS Journal; Jul.-Dec. 1988 (pp. 19-42).
(Continued)

*Primary Examiner* — Rodney Mintz
(74) *Attorney, Agent, or Firm* — D. Peter Hochberg; Sean F. Mellino

(57) ABSTRACT

A self-reinforced masonry block comprises a main body having opposed substantially parallel stacking surfaces and at least one tubular cell defined therethrough from one stacking surface to the other. At least one confining reinforcement is embedded in the main body to surrounding a corresponding cell. Each confining reinforcement extends substantially entirely along the longitudinal length of its corresponding cell and terminates inwardly of the stacking surfaces. The self-reinforced masonry blocks may be used in construction of a grout-filled, vertically reinforced masonry block wall, with the self-reinforced masonry blocks being used for those portions of the wall where the grouted cells are prone to crushing due to high levels of compressive stress, and conventional unreinforced masonry blocks being used for other portions of the wall. A method for making the self-reinforced masonry blocks is also described.

13 Claims, 10 Drawing Sheets

(51) Int. Cl.

| | |
|---|---|
| ***B28B 7/18*** | (2006.01) |
| ***B28B 23/02*** | (2006.01) |

(56) References Cited

U.S. PATENT DOCUMENTS

| | | | | | |
|---|---|---|---|---|---|
| 990,119 | A | * | 4/1911 | Diamond | 52/591.5 |
| 1,761,848 | A | * | 6/1930 | Sitzman et al. | 52/125.4 |
| 3,681,870 | A | * | 8/1972 | Alpert | 446/122 |
| 3,752,626 | A | * | 8/1973 | Trautner et al. | 425/262 |
| 3,780,484 | A | * | 12/1973 | Muse | 52/585.1 |
| RE28,902 | E | * | 7/1976 | Trautner et al. | 425/262 |
| 4,532,745 | A | * | 8/1985 | Kinard | 52/251 |
| 4,658,561 | A | * | 4/1987 | Russell | 52/662 |
| 4,802,836 | A | * | 2/1989 | Whissell | 425/253 |
| 4,947,610 | A | * | 8/1990 | Koerner | 52/585.1 |
| 5,024,035 | A | * | 6/1991 | Hanson et al. | 52/591.1 |
| 5,103,616 | A | * | 4/1992 | Nordberg | 52/585.1 |
| 5,214,897 | A | * | 6/1993 | Nordberg | 52/585.1 |
| 5,755,216 | A | * | 5/1998 | Salyer | 126/618 |
| 5,768,847 | A | * | 6/1998 | Policelli | 52/649.1 |
| 5,809,732 | A | | 9/1998 | Farmer, Sr. et al. | |
| 5,966,889 | A | * | 10/1999 | Zinner | 52/606 |
| 6,161,357 | A | * | 12/2000 | Altemus | 52/592.6 |
| 6,401,420 | B1 | * | 6/2002 | Salls | 52/600 |
| 6,571,525 | B2 | * | 6/2003 | Coleman | 52/592.5 |
| 6,705,057 | B2 | * | 3/2004 | Smyer, III | 52/606 |
| 7,546,712 | B2 | * | 6/2009 | Shaw | 52/223.8 |
| 7,712,997 | B2 | * | 5/2010 | Roelfsema | 405/45 |
| 8,495,850 | B1 | * | 7/2013 | Lin | 52/592.6 |
| 8,955,282 | B2 | * | 2/2015 | Yap Ching | 52/585.1 |
| 2002/0112437 | A1 | * | 8/2002 | Queen | 52/677 |
| 2004/0250497 | A1 | * | 12/2004 | Hagel et al. | 52/698 |
| 2005/0050837 | A1 | * | 3/2005 | Wang | 52/721.3 |
| 2005/0055922 | A1 | * | 3/2005 | Shamsai et al. | 52/319 |
| 2005/0115185 | A1 | * | 6/2005 | Telford et al. | 52/596 |
| 2005/0257481 | A1 | * | 11/2005 | Shaw | 52/606 |
| 2006/0032184 | A1 | * | 2/2006 | Almeter | 52/736.3 |
| 2007/0107364 | A1 | * | 5/2007 | Estes et al. | 52/606 |
| 2007/0186492 | A1 | * | 8/2007 | Bennett et al. | 52/125.4 |
| 2007/0289247 | A1 | * | 12/2007 | Hamel | 52/596 |
| 2008/0060312 | A1 | * | 3/2008 | Hung | 52/596 |
| 2008/0256894 | A1 | | 10/2008 | Marsh et al. | |
| 2009/0057531 | A1 | * | 3/2009 | Waite et al. | 249/48 |
| 2009/0120025 | A1 | * | 5/2009 | Sezen et al. | 52/340 |
| 2009/0173027 | A1 | * | 7/2009 | Bennett | 52/309.17 |
| 2009/0314186 | A1 | * | 12/2009 | Rodgers | 106/706 |
| 2011/0108151 | A1 | * | 5/2011 | Lee | 138/175 |
| 2012/0102863 | A1 | * | 5/2012 | Yap Ching | 52/415 |
| 2012/0311953 | A1 | * | 12/2012 | Antal | 52/604 |
| 2014/0361454 | A1 | * | 12/2014 | Molitor et al. | 264/69 |
| 2015/0075106 | A1 | * | 3/2015 | Vandenbempt | 52/596 |

OTHER PUBLICATIONS

Priestley, M.J.N.; Ductility of Unconfined and Confined Concrete Masonry Shear Walls; TMS Journal; Jul.-Dec. 1981 (pp. 28-39).

Cutler, Phillip, P.E.; "Zero-Slump Concrete: A Straight-Up Tool in a Tough Market;" Precast Inc. Magazine; http://precast.org/2012/11/zero-slump-concrete-a-straight-up-tool-in-a-tough-market; Nov. 9, 2012.

* cited by examiner

SELF-REINFORCED MASONRY BLOCKS, WALLS MADE FROM SELF-REINFORCED MASONRY BLOCKS, AND METHOD FOR MAKING SELF-REINFORCED MASONRY BLOCKS

CROSS-REFERENCE TO RELATED APPLICATION

This application is a U.S. National Stage application of International Application No. PCT/CA2011/001043, filed on Sep. 14, 2011, which claims priority to U.S. Provisional Application No. 61/382,964 filed on Sep. 15, 2010, both of which are incorporated herein by reference in their entireties.

FIELD OF INVENTION

The present invention relates to masonry blocks, and more particularly to self-reinforced masonry blocks.

BACKGROUND OF THE INVENTION

Common masonry walls are made of hollow concrete blocks and mortar; the hollow portions of the blocks are typically referred to as "cells". The cells reduce the weight of block that the mason must lift into place during construction, and also enable vertical reinforcement to be installed in the wall. For added resistance to lateral loads, grout and vertical reinforcements, such as steel reinforcing bars, are placed in the cells of the block. Filling of the block cells also enhances the compression strength of concrete block walls under vertical loads. Placing vertical steel reinforcing bars in the block cells enhances the flexural strength of the wall to improve ductility through yielding of this reinforcing bar. However, the extent of ductility is limited by compression failure of the concrete block at relatively low compression strain.

In seismic design for earthquake loading, concrete block shear walls that are intended to resist the horizontal forces caused by seismic motion must be reinforced to increase their flexural strength and to develop some ductility and energy dissipation properties. However, it is very challenging to achieve sufficient ductility and energy dissipation prior to compression failure of the concrete block. Reinforced concrete block construction must often be designed for nearly twice as much lateral loading as the more ductile competing construction materials such as reinforced concrete structures and steel structures. Hence, reinforced concrete block construction is often not economically competitive and sometimes not technically feasible. Changes in recent building codes have imposed limitations affecting reinforced masonry construction with the result that use of this most common building material has been significantly limited.

Another aspect of structural design relates to the limit states with which building design must comply, namely the "serviceability limit state" and the "ultimate limit state". The serviceability limit state deals with the normal course of building performance under expected loads, and requires that in these circumstances the building should not show any sign of distress and should function in the intended manner. The ultimate limit state is directed to providing a margin of safety against failure by designing for a higher load than is actually anticipated and by making allowance for variability in material strength, for example to deal with unexpected overloading or weaknesses that may develop.

More recently, the concept of design to accept damage but prevent collapse has been introduced, particularly in relation to seismic forces and other forces that are more difficult to predict. This design concept is directed to conditions beyond the ultimate limit state, at which point permanent damage is experienced. Where a structure has been appropriately designed to accept damage but prevent collapse, in conditions beyond the ultimate limit state but within the design limit, the structure may be visibly damaged but will retain most (at least 80%) of its original strength and, in the case of earthquakes, the additional accepted damage produces increased ductility and energy dissipation. This additional ductility and energy dissipation allows design for lower lateral forces for cases of low probability of occurrence such as either the 1 in 475 year or 1 in 2500 year earthquake that is currently designed for in most countries. In the event of such an earthquake, damage would occur but the building would not collapse and thus deaths, injuries and collateral damage may be reduced. Depending on the extent of damage, it might be economical to repair the building.

There are two related but separate aspects of behavior of grout-filled hollow masonry block construction subjected to vertical compression, such as is created in concrete block shear walls by gravity loading and by loading resulted from lateral seismic forces: interaction between grout in the cells and the mortared hollow masonry block, and brittle compression failure of grout-filled hollow masonry block.

Reference is first made to the interaction between grout in the cells and the mortared hollow masonry block. In standard hollow block construction, compression failure occurs at stresses well below the compressive strength of individual blocks as a result of incompatibility between the mortar and the block material. Under vertical compression, the larger lateral expansion of the softer mortar creates lateral tension in the blocks which results in development of vertical cracks through the webs and face shells of the block, leading to sudden crushing of the combined material at relatively low levels of vertical strain. Thus, compressive strength of the combination can be predicted based on mortar type and compressive strength of the block. However, when grout is used to fill the cells created in the hollow concrete block construction, addition of this third material creates a more complex condition where the different stress-strain properties of the grout, the discontinuities in the column of grout created by imperfect alignment of the block cells from course to course, wedging action due to the tapered shape of face shells and webs, and shrinkage of the grout, all combine to produce a lower material strength than attained in the ungrouted assemblage. The addition of the grout increases the overall capacity of the structure but, when considering the increased solid area of the grouted cross-section, the stress at failure is typically about 25% lower than for ungrouted hollow masonry, with strength based on failure load (capacity) divided by the effective net area of the assemblage. Increasing the grout strength has only a minor effect on the overall compressive capacity.

Although changes in geometry of the cells in the hollow masonry block and use of shrinkage compensating grout can reduce the decrease in observed strength, these approaches are not fully effective and have undesirable economic impact. Reducing the volume of grout to about 25% of the gross volume and improving the vertical alignment of the cells in successive courses of block masonry can help address the undesirable decrease in strength. For example, for a nominal 20 cm (8 inch) block, a 100 mm (4 inch) diameter cylindrical shaped cell occupies approximately 21% of the gross volume and gross cross-sectional area and, combined with positioning of these blocks so that the cells align from course to course, results in higher compressive strength than traditional grouted hollow block construction.

Turning now to brittle compression failure of grout filled hollow masonry block, despite the improved compressive strength created by the block geometry described above, the mode of compression failure remains the same: development of vertical cracks and sudden crushing/crumbling of the grouted assemblage. This brittle property of grouted masonry and of concrete products in general has been understood for some time as a limiting factor in use of concrete block construction, particularly for seismic design where economic design requires ductile behavior.

It has been shown that lateral confinement of brittle materials such as concrete creates a state of tri-axial compression under vertical axial compression loading so that both higher strengths of the material are obtained and much higher vertical strains are reached prior to crushing and crumbling of the block under the vertical compression load. Both the strength increase and the greater deformability can be used to create more ductile reinforced concrete block shear walls to better resist lateral earthquake load.

A number of strategies have been employed in attempts to introduce lateral confinement into grouted concrete block construction. These confining methods are generally passive in that vertical deformation is required to introduce the confining effects. With vertical compression of the material, lateral expansion of the material takes place where the ratio between the amount of lateral expansion and the vertical compression is known as Poisson's Ratio. At low levels of loading, this ratio is about 0.21 but at high levels of stress this can increase significantly and create what is referred to as dilation. Introduction of confining reinforcement to resist the lateral expansion introduces tension in the horizontal (lateral) reinforcement and a balancing amount of lateral compression in the grouted concrete block. The tri-axial state of compressive stress in the confined region is what creates the much higher compressive strength and greatly increased deformability of the confined material.

One method using a confining reinforcement to enhance the compression capacity and deformability of a grouted section involves placing steel wire mesh, perforated plates, and/or fiber reinforced polymer (FRP) fabric/laminates within the mortar bed joints. For example, Priestley (Priestley, M. J. N. Ductility of Unconfined and Confined Concrete Masonry Shear Walls. *TMS Journal*, July-December 1981, pp. 28-39) studied concrete masonry prisms confined with 3 mm thick stainless steel plates within the mortar beds. The plates were cut to the net shape of the masonry units so that there was no interference with the grouted cells, with a 5 mm edge allowance for pointing the mortar bed joints. The confined prisms showed increased strength, higher strains at peak load, and a much flatter falling branch of the stress-strain curves. PCT Patent Application No. PCT/US2005/25477, published as WO2006/020261, teaches other methods using confining reinforcement.

U.S. Pat. No. 5,809,732 teaches concrete masonry blocks with one or more external plates that are formed with the plates anchored through the block to enable items to be anchored to a wall built with these blocks. A masonry wall can be constructed using masonry blocks with external plates at preselected locations to anchor items to the wall by attaching them to the plates. The external plates are directed to supporting the anchoring function rather than to reinforcing the wall.

Another proposed technique was to provide lateral confinement for just the grout, for instance by using a spiral coil shape of reinforcement placed inside the block cell prior to grouting.

Hart et al. (Hart, G. C. et al. The Use of Confinement Steel to Increase the Ductility in Reinforced Concrete Masonry Shear Walls. TMS Journal, July-December 1988, pp. 19-42) conducted a comprehensive test program to investigate different types of confinement such as wire mesh, a modified "Priestley Plate", hoops and spirals. In order to maintain consistent vertical reinforcing throughout all prism tests, one No. 6 bar was provided in each cell. The conclusions were: (1) unreinforced and vertically reinforced unconfined prisms behaved identically and failed in a brittle manner; (2) all types of confinement had a positive effect on the descending portion of the stress-strain curve and increased the area under the stress-strain curve; (3) the Priestley Plate provided the greatest confinement; and (4) the open wire mesh confinement type performed well.

For concrete block construction with standard block sizes, placing confining reinforcements within the mortar bed joints, as suggested by Priestly, means using a 200 mm (8 inch) vertical spacing between the confining reinforcements (i.e., the distance between successive bed joints). Such a large spacing limits the effectiveness of the confinement and effectiveness of support against buckling of enclosed vertical compression reinforcement. Reducing the height of the blocks to reduce the spacing distance demands handling more blocks and laying more mortar, which can dramatically increase construction cost. Similarly, increased construction labour is associated with placement of spiral coil reinforcements inside the block cell prior to grouting. In addition, the effectiveness of such reinforcement is limited because, for a typical grouted cell occupying less than 45% of the solid volume, less than 30% of the section can be effectively confined. Following crumbling of the block and grout outside of the spiral, the residual confined area is prone to buckling and cannot develop sufficient extra strength to compensate for the area lost after the material outside of the confined region fails in compression.

Thus, achieving increased ductility in masonry block construction using techniques mentioned above involves practical difficulties and may also involve significantly increased labour costs.

SUMMARY OF THE INVENTION

In one aspect, the present invention is directed to a self-reinforced masonry block. The self-reinforced masonry block comprises a main body having opposed substantially parallel stacking surfaces and having at least one tubular cell defined therethrough from one of the stacking surfaces to the other stacking surface. Each cell has a longitudinal axis and a longitudinal length defined by the stacking surfaces. At least one hollow confining reinforcement is embedded in the main body, with each confining reinforcement surrounding a corresponding cell along the longitudinal length thereof. Each confining reinforcement extends substantially entirely along the longitudinal length of its corresponding cell and terminates inwardly of the stacking surfaces.

In one embodiment, each confining reinforcement is spaced outwardly from its corresponding cell, and in a particular embodiment each confining reinforcement is porous.

In one embodiment, the main body of the self-reinforced masonry block is formed from concrete.

In one embodiment, each confining reinforcement is tubular. In one particular embodiment, each cell and each confining reinforcement is substantially circular in cross-section, and in another particular embodiment, each cell and each confining reinforcement is substantially square in cross-section.

The confining reinforcements may comprise, for example, cold formed steel, hot-rolled steel, aluminum, glass, carbon fiber composites and fiber reinforced polymer. In one particular embodiment, each confining reinforcement comprises a metal sheet formed into a tube and having perforations therein. In another particular embodiment, each confining reinforcement comprises a mesh material.

In another aspect, the present invention is directed to a method for making a self-reinforced concrete block. The method comprises placing at least one hollow confining reinforcement inside a main cavity of a block mold, inwardly of side walls of the main cavity, introducing concrete mix into the main cavity to fill the main cavity while leaving at least one cell region within the main cavity substantially devoid of concrete, with the confining reinforcement(s) being positioned to surround a corresponding cell region, closing the mold, and vibrating the closed mold and applying compression to the concrete mix to form the concrete block.

In a particular embodiment, the method further comprises placing at least one cell mold element inside the main cavity, inwardly of side walls of the main cavity, so that the cell mold element(s) define the cell region(s). Positioning of the confining reinforcement to surround a corresponding cell region results from the confining reinforcement(s) and the cell mold element(s) being arranged so that for each confining reinforcement, the corresponding cell mold element is disposed inside and inwardly spaced from that confining reinforcement. In one embodiment, the confining reinforcement(s) are placed inside the main cavity after the cell mold element(s) are placed inside the main cavity, and in another embodiment the confining reinforcement(s) are placed inside the main cavity simultaneously.

In another aspect, the present invention is directed to a wall comprising a plurality of self-reinforced masonry blocks as well as a plurality of unreinforced masonry blocks. Each of the self-reinforced masonry blocks and the unreinforced masonry blocks comprises a main body having opposed substantially parallel stacking surfaces and at least one tubular cell defined therethrough from one of the stacking surfaces to the other stacking surface, with each cell having a longitudinal axis and a longitudinal length defined by the stacking surfaces. Each self-reinforced masonry block further comprises at least one hollow confining reinforcement embedded in the main body of the self-reinforced masonry block, with each confining reinforcement surrounding a corresponding cell in the self-reinforced masonry block along the longitudinal length of that cell. Each confining reinforcement extends substantially entirely along the longitudinal length of its corresponding cell in that self-reinforced masonry block and terminates inwardly of the stacking surfaces of that self-reinforced masonry block.

Both the self-reinforced masonry blocks and the unreinforced masonry blocks are arranged in a stacked configuration in which the cells of vertically adjacent masonry blocks are in registration with one another to define vertically extending tubular cavities. The wall comprises edge portions and intermediate portions between the edge portions, with the intermediate portions comprising the unreinforced masonry blocks and at least base regions of the edge portions are composed of the self-reinforced masonry blocks. All of the outermost vertically extending tubular cavities in the edge portions are filled with grout and have a resilient reinforcement member extending vertically therethrough and embedded in the grout.

In one embodiment, at least some of the vertically extending tubular cavities in the intermediate portions are filled with grout and have a resilient reinforcement member extending vertically therethrough and embedded in the grout.

The edge portions may comprise opposed vertically extending ends of the wall, and may further comprise vertically extending portions of the wall adjacent an opening therein.

In one embodiment, the self-reinforced masonry blocks and the unreinforced masonry blocks are concrete blocks.

In one embodiment, the confining reinforcements in the self-reinforced masonry blocks are spaced outwardly from their corresponding cells, and in a particular embodiment the confining reinforcements are porous.

In one embodiment, the wall further comprises mortar disposed between the stacking surfaces of vertically adjacent masonry blocks.

BRIEF DESCRIPTION OF THE DRAWINGS

These and other features of the invention will become more apparent from the following description in which reference is made to the appended drawings wherein.

DETAILED DESCRIPTION

Figure 1A:
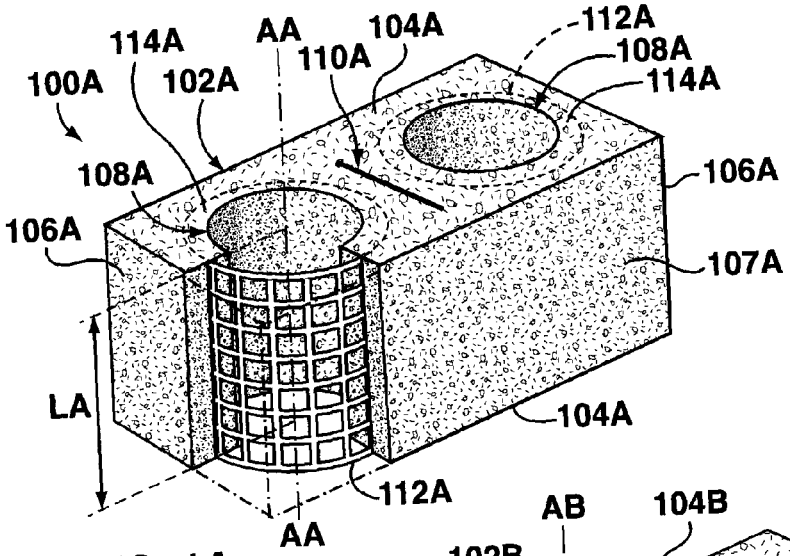
FIG. 1A is a cut-away perspective view of a first exemplary self-reinforced masonry block, according to an aspect of the present invention.

Reference is now made to FIG. 1A, which shows an exemplary self-reinforced masonry block 100A according to an aspect of the present invention. The masonry block 100A comprises a main body 102A having opposed substantially parallel stacking surfaces 104A. The main body 102A of the illustrated masonry block 102A is formed from concrete. In the illustrated embodiment the main body 102A is parallepipedic, and hence also has flat ends 106A that are architecturally suitable for use at the ends of walls, where the highest compressive stresses occur in shear walls during a seismic event, and flat side walls 107A. The exemplary masonry block 100A in FIG. 1A has dimensions of 190×190×390 mm $$\left(7\frac{5}{8}\times 7\frac{5}{8}\times 15\frac{5}{8}\text{ inches}\right)$$

inches) and has the same external size and shape as, and is therefore compatible with, standard conventional concrete blocks of the same dimensions. Other suitable shapes and sizes may also be used for self-reinforced masonry blocks according to aspects of the present invention. A pair of hollow circular tubular cells 108A are defined through the main body 102A from one of the stacking surfaces 104A to the other stacking surface 104A, with each cell having a longitudinal axis AA that is substantially perpendicular to the stacking surfaces 104A and a longitudinal length LA defined by the stacking surfaces 104A. The exemplary masonry block 100A shown in FIG. 1A is a "splitter" block having a splitter cell 110A, as is known in the art, to enable the single masonry block 100A to be split into two half size blocks (not shown), each having a single cell 108A, for use in standard running bond construction as is known in the art.

Two hollow confining reinforcements 112A are embedded in the main body 102A. Each of the confining reinforcements 112A surrounds a corresponding cell 108A along the longitudinal length LA thereof, and extends substantially entirely along the longitudinal length LA of the corresponding cell 108A to terminate immediately inwardly of the stacking surfaces 104A. The confining reinforcements 112A are circular in cross-section so that their cross-sectional shape corresponds to the circular cross-sectional shape of the cells 108A.

In the exemplary embodiment shown in FIG. 1A, each confining reinforcement 112A is spaced outwardly from its corresponding cell 108A, so that there is an annular region 114A of concrete between the confining reinforcement 112A and the void of the cell 108A. The confining reinforcements 112A are circumferentially continuous. Although there are apertures 220 (FIG. 2A) in the confining reinforcements 112A, there is no aperture that extends the entire length of the confining reinforcement 112A to disrupt the circumferentially continuity. As a result of the confining reinforcements 112A being circumferentially continuous, when the masonry blocks 100A are arranged into a wall as described further below, "hoop tension" can be developed as the concrete in the annular region 114A between the confining reinforcement 112A and the cell 108A expands laterally. Since the confining reinforcements 112A extend substantially entirely along the longitudinal length of the corresponding cell 108A and terminate immediately inwardly of the stacking surfaces 104A, only the small portions of the concrete in the annular region 114A adjacent the stacking surfaces 104A are not directly confined by the confining reinforcement 112A. When a wall is formed from the masonry blocks 100A shown in FIG. 1A the these small portions will be confined effectively by their close proximity to the confining reinforcements 112A in the vertically adjacent masonry blocks 100A above and below.

Figure 1B:
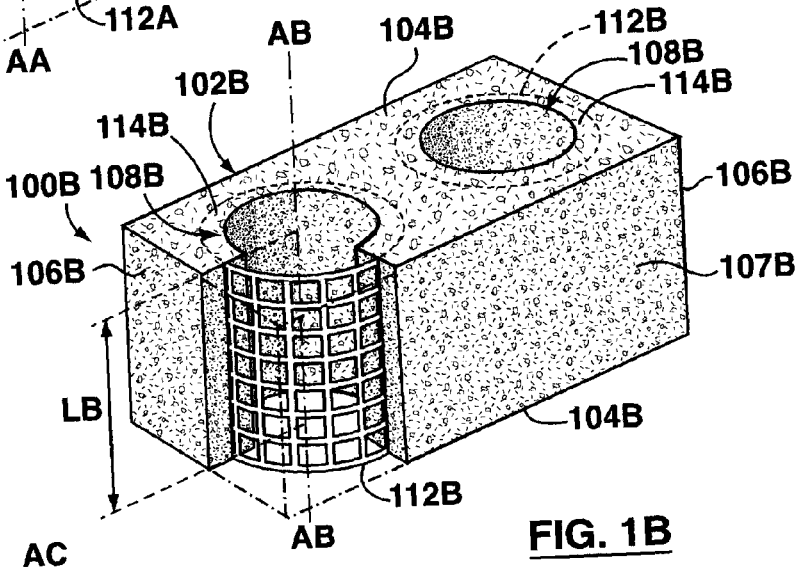
FIG. 1B is a cut-away perspective view of a second exemplary self-reinforced masonry block, according to an aspect of the present invention.
Figure 1C:
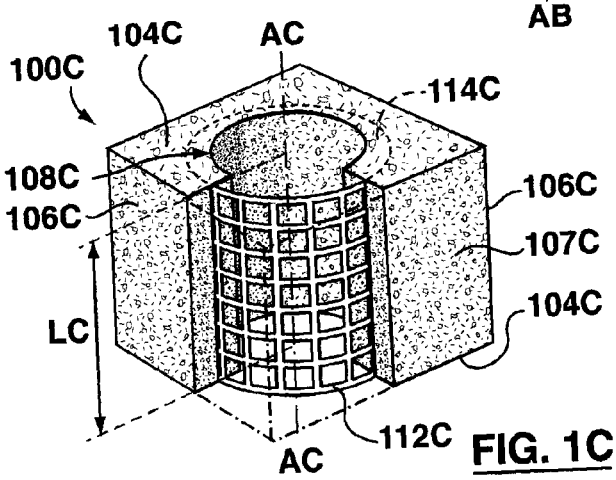
FIG. 1C is a cut-away perspective view of a third exemplary self-reinforced masonry block, according to an aspect of the present invention.

Some manufacturers may prefer to manufacture "half length" masonry blocks having only a single cell, and in such cases the "full length" blocks with two cells would not need to be "splitter" blocks. FIG. 1B shows a masonry block 100B which is identical to the masonry block 100A shown in FIG. 1A except that the masonry block 100B in FIG. 1B does not include a splitter cell, and FIG. 1C shows a masonry block 100C that is half the length of the masonry blocks 100A, 100B in FIGS. 1A and 1B and includes only a single cell 108C and a single corresponding confining reinforcement 112C. The masonry blocks 100B, 100C, shown in FIGS. 1B and 1C are otherwise identical to the masonry block 100A shown in FIG. 1A, and thus like reference numerals are used to refer to like features, except with the suffix "B" and "C", respectively. In other embodiments, a "full length" block may include one cell that is surrounded by a confining reinforcement and another cell that is not reinforced.

Figure 2A:
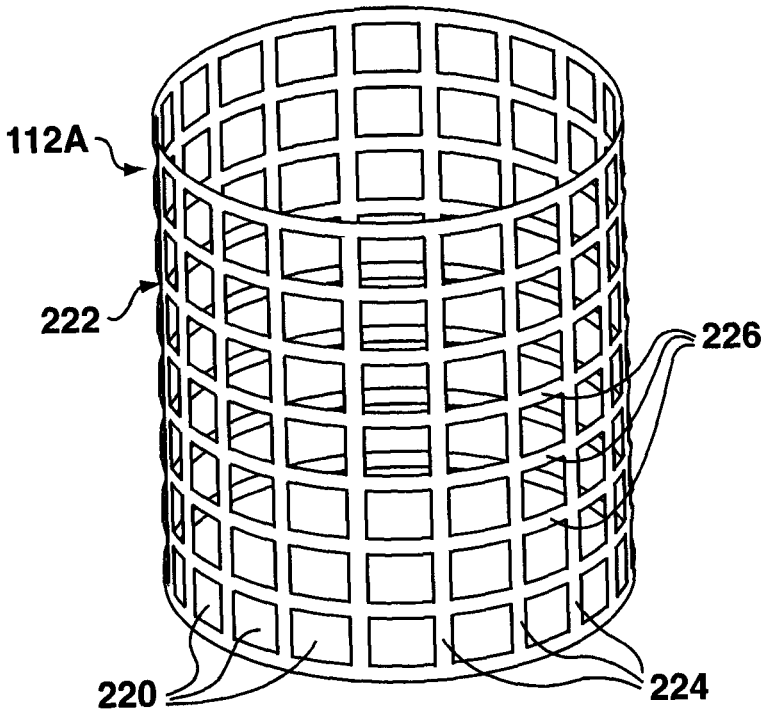
FIG. 2A is a perspective view of an exemplary confining reinforcement for the self-reinforced masonry blocks of FIGS. 1A, 1B and 1C.

Referring now to FIG. 2A, the exemplary confining reinforcement 112A of FIG. 1A is shown in more detail. As can be seen, the confining reinforcement 112A is porous in that a plurality of apertures 220 are defined through the tubular wall 222 thereof. The tubular wall 222 of the exemplary confining reinforcement 112A in FIG. 2A is formed from a mesh material, and comprises longitudinally extending elements 224 and circumferentially extending elements 226 that are interconnected with one another. The circumferentially extending elements 226 are continuous and hence provide circumferential continuity of the confining reinforcement 112A.

Figure 2B:
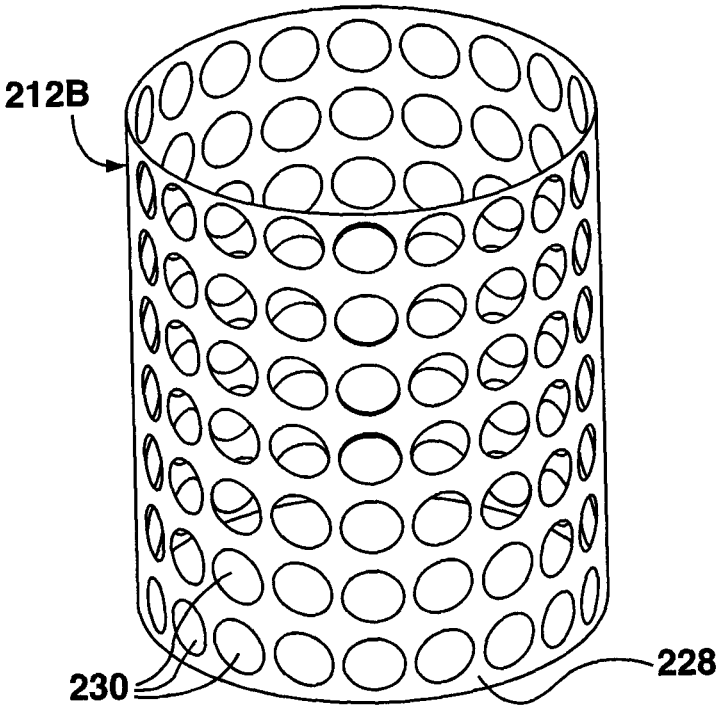
FIG. 2B is a perspective view of a second exemplary confining reinforcement for self-reinforced masonry blocks according to an aspect of the present invention.

FIG. 2B shows an alternative embodiment of a porous confining reinforcement 212B for use with masonry blocks according to aspects of the present invention. The confining reinforcement 212B comprises a metal sheet 228 formed into a circular tube and having perforations 230 therein.

Depending on the geometry of the masonry block and the cells thereof, confining reinforcements for use with masonry blocks according to aspects of the present invention may have other cross-sectional shapes besides circular. For example, confining reinforcements may have an oval cross-section or a square or other polygonal cross-section, or may comprise a spiral. Additionally, the cross-sectional shape of a confining reinforcement need not be identical to the cross-sectional shape of the corresponding cell. The size and shape of the cells will impact aspects such as compactability of the concrete mix used in manufacture, the size and shape of the confining reinforcement that will fit within the self-reinforced masonry block, and the concrete cover over the confining reinforcement, which may affect corrosion protection (if applicable) and fire resistance (if required). Selection of appropriate cell size and shape is within the capability of one skilled in the art, now informed by the herein disclosure.

Preferably, both the cross-sectional shape of the cell and the cross-sectional shape of the confining reinforcement are substantially circular. Also preferably, the confining reinforcement is sized and positioned so that approximately 75% of the gross area, including the concrete of the main body and the cell that will be filled with grout, will be confined by the confining reinforcement.

Figure 7A:
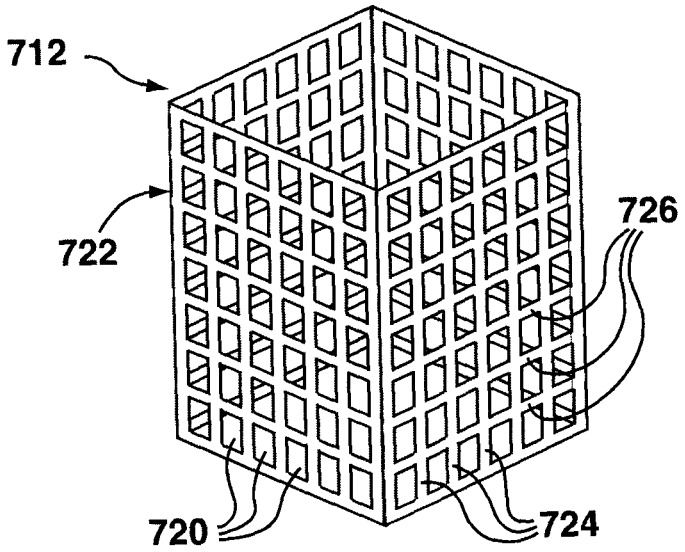
FIG. 7A is a perspective view of a third exemplary confining reinforcement for self-reinforced masonry blocks according to an aspect of the present invention.
Figure 7B:
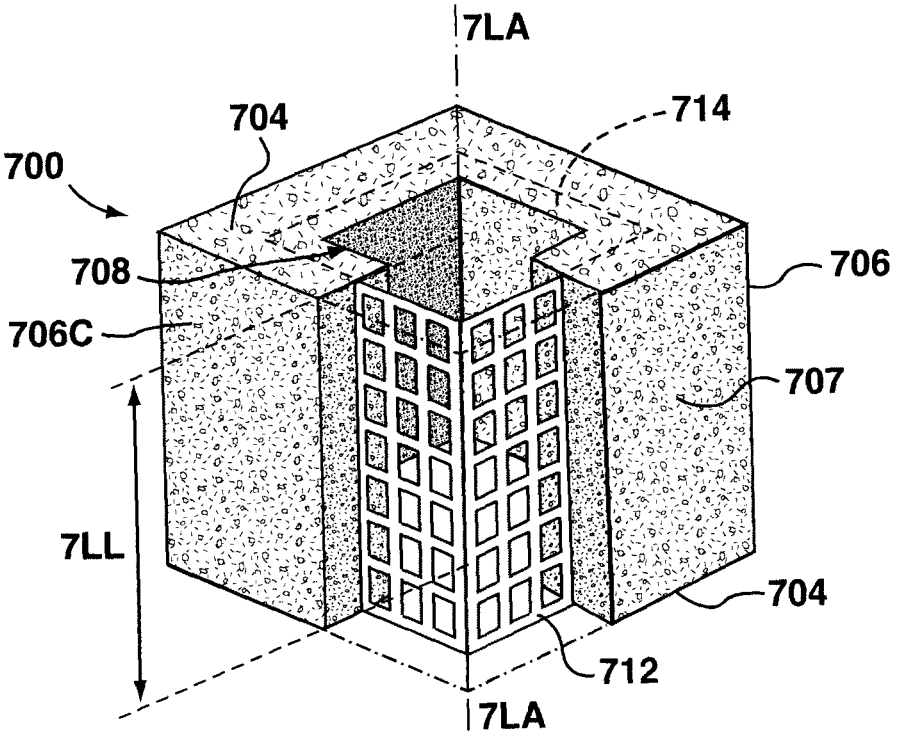
FIG. 7B is a perspective view of self-reinforced masonry blocks incorporating the confining reinforcement of FIG. 7A, according to an aspect of the present invention.

FIG. 7A shows a confining reinforcement 712 that is similar to the confining reinforcement 112A shown in FIGS. 1A to 1C and 2B except that it is of substantially square cross-section rather than circular, and FIG. 7B shows an exemplary "half length" masonry block 700 incorporating the confining reinforcement 712 of FIG. 7A. The confining reinforcement 712 in FIGS. 7A and 7B is otherwise identical to the confining reinforcement 112A in FIGS. 1A to 1C and 2B, and the masonry block 700 in FIG. 7B is identical to the masonry block 100C in FIG. 1C except that the cell 708 and confining reinforcement 712 of the masonry block 700 in FIG. 7 are of substantially square cross section. Hence, features in FIGS. 7A and 7B corresponding to features in FIGS. 1C and 2B are denoted using the same reference numerals except with the prefix "7" instead of "1" or "2" and with no suffix, and with the longitudinal axis denoted by 7LA and the longitudinal length denoted by 7LL.

Confining reinforcements for masonry blocks according to aspects of the present invention may be made of any suitable material, including cold formed or hot-rolled steel, galvanized steel, aluminum or special alloys, each of which may be corrugated, glass, carbon fiber composites, or different types of fiber reinforced polymer (FRP) products such as laminates. The perforation or aperture pattern and the cross sectional area of the confining reinforcements will be selected according to the design requirements or the class of the masonry block of which it will form a part, i.e., the required level of lateral confinement. The choice of shape and thickness of material used to fabricate the confining reinforcements will also be affected by the ability to form the material into a circumferentially continuous hollow tube capable of resisting lateral tension created by confining the enclosed material such as concrete and/or grout. Additional factors affecting the choice of shape and thickness of the material used to fabricate the confining reinforcements relates to the process of manufacturing the masonry blocks, and are discussed in more detail below.

Figure 3:
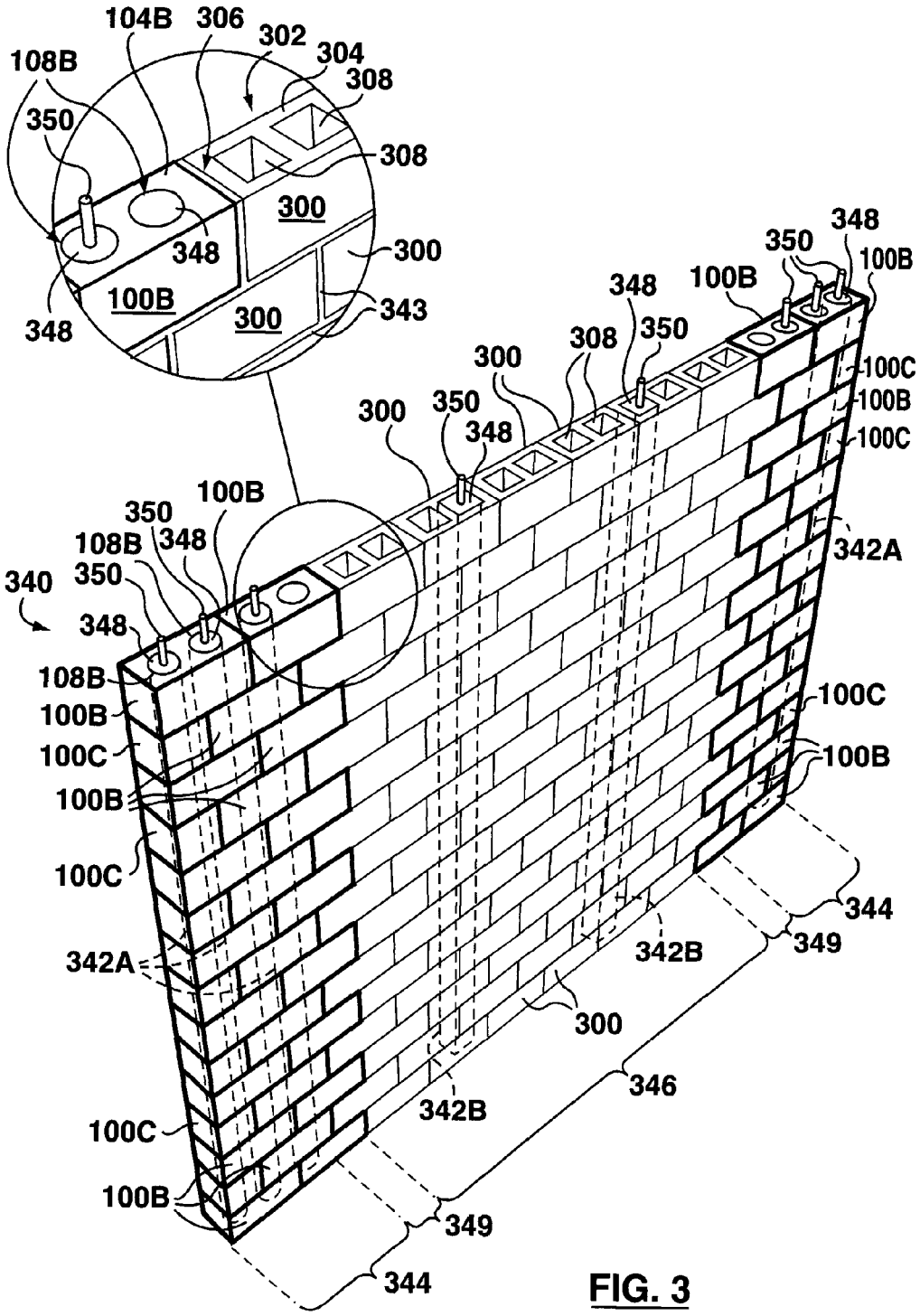
FIG. 3 is a perspective view of a first exemplary wall incorporating self-reinforced masonry blocks according to an aspect of the present invention.
Figure 4:
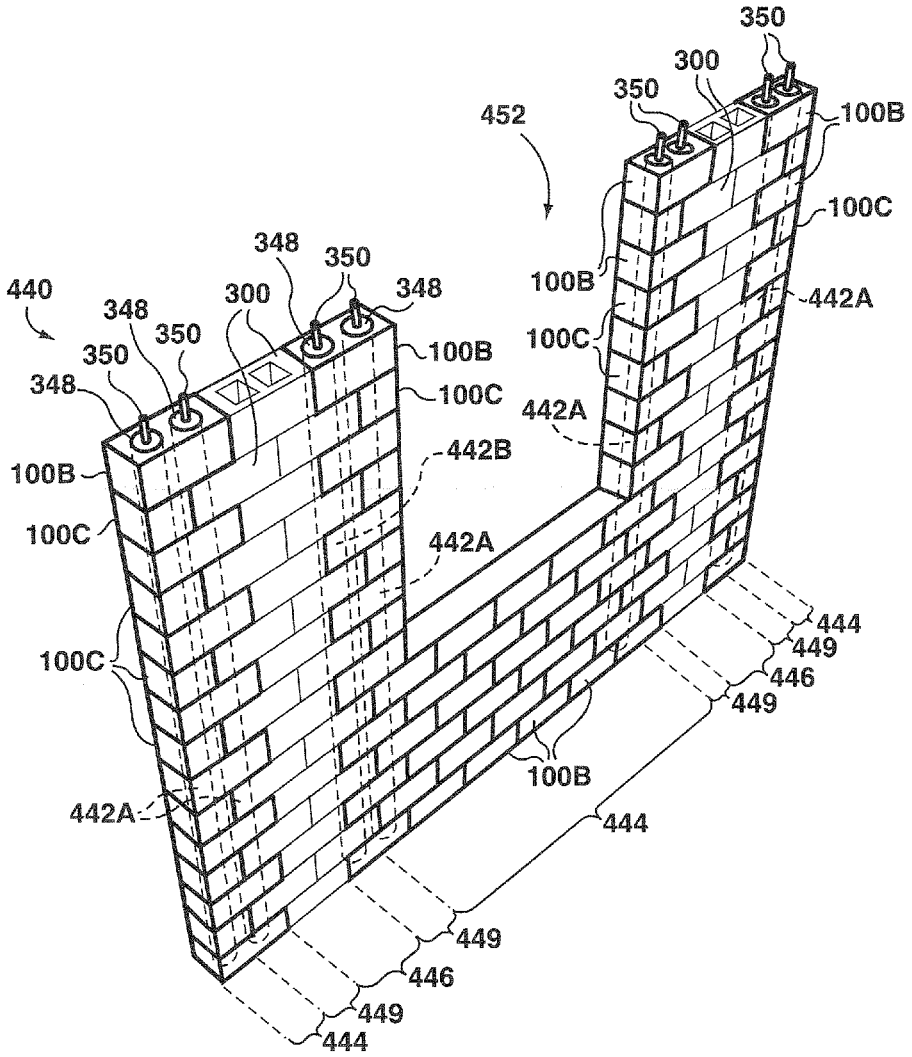
FIG. 4 is a perspective view of a second exemplary wall incorporating self-reinforced masonry blocks according to an aspect of the present invention.
Figure 5:
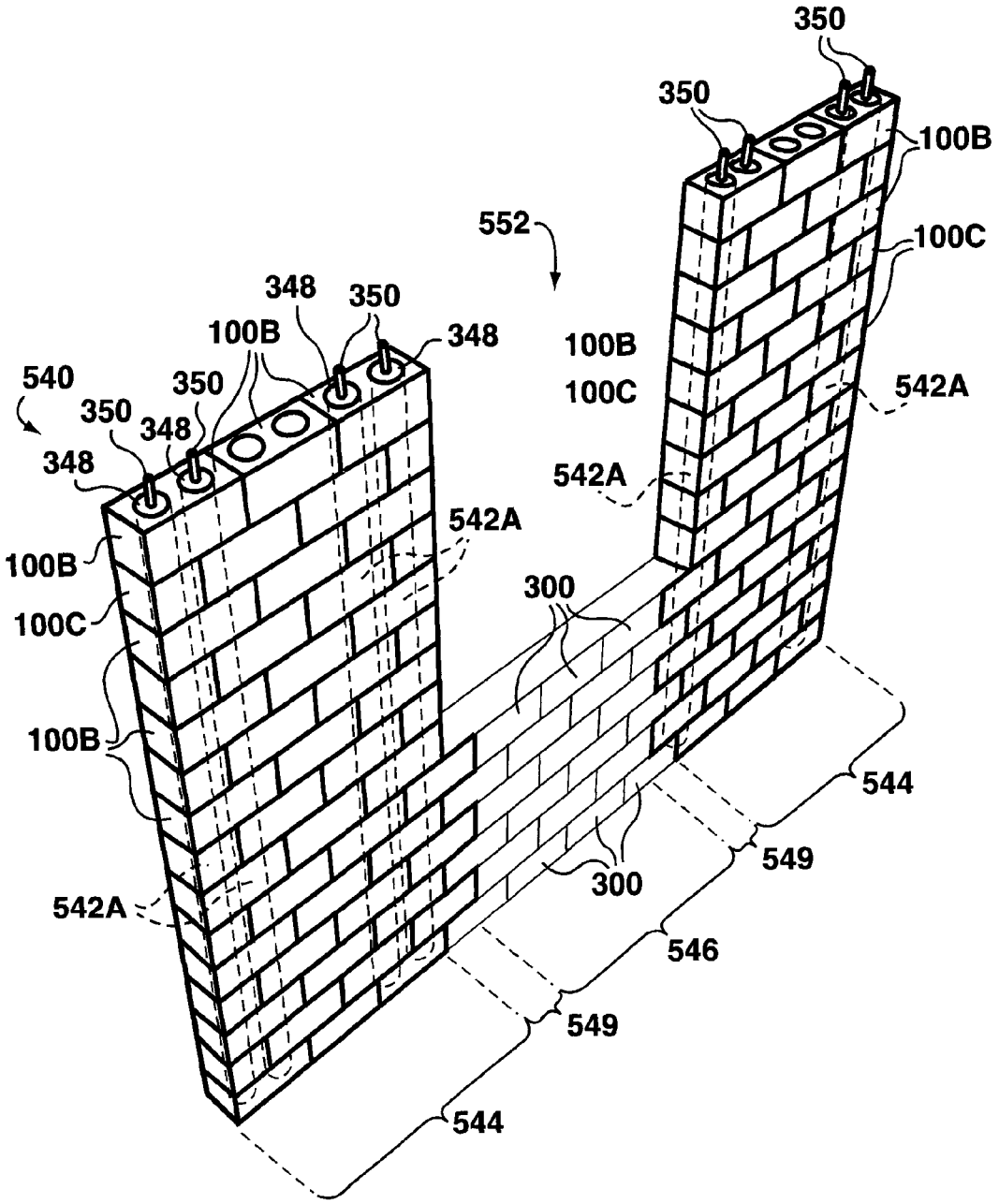
FIG. 5 is a perspective view of a third exemplary wall incorporating self-reinforced masonry blocks according to an aspect of the present invention.

Reference will now be made to FIGS. 3, 4 and 5, which show exemplary walls 340, 440, 540, respectively, constructed from a plurality of self-reinforced concrete masonry blocks according to aspects of the present invention in combination with a plurality of conventional, unreinforced concrete masonry blocks 300. In FIGS. 3, 4 and 5, the self-reinforced concrete masonry blocks are the self-reinforced concrete masonry blocks 100B, 100C shown in FIGS. 1B and 1C, and are marked with bold lines to distinguish them from the conventional, unreinforced concrete masonry blocks 300. Any self-reinforced masonry block according to an aspect of the present invention may be used. In order to avoid unduly cluttered drawings, not all of the masonry blocks are marked with reference numerals.

Like the self-reinforced concrete masonry blocks 100B, 100C, the unreinforced concrete masonry blocks 300 each comprise a main body 302 having opposed substantially parallel stacking surfaces 304, flat ends 306, and at least one tubular cell 308 defined through the main body 302 from one of the stacking surfaces 304 to the other. However, the unreinforced concrete masonry blocks 300 do not include a confining reinforcement of the type shown in FIGS. 1A to 1C or FIG. 7B, and it is in this sense that the term "unreinforced" is used.

The walls 340, 440, 540 are formed by arranging the self-reinforced masonry blocks 100B, 100C and the unreinforced masonry blocks 300 in a stacked configuration wherein the respective cells 108B, 108C, 308 of vertically adjacent masonry blocks 100B, 100C, 300 are in registration with one another to define vertically extending tubular cavities 342A, 342B (FIG. 3), 442A, 442B (FIG. 4) and 542A (FIG. 5). As shown in FIG. 3, in the illustrated embodiments adjacent masonry blocks 100B, 100C, 300 are secured to one another by mortar 343 disposed between the stacking surfaces 104B, 104C, 304 and between the flat ends 106B, 106C, 306 of adjacent masonry blocks 100B, 100C, 300.

Typically, as shown in FIGS. 3 to 5, in each vertically successive course of masonry blocks 100B, 100C, 300 the masonry blocks 100B, 100C, 300 are laterally offset from one another, by one half the length of a "full length" masonry block, so that each "full length" masonry block 100B, 300 (other than those in the top and bottom course) will rest upon two masonry blocks 100B, 100C, 300 and support two masonry blocks 100B, 100C, 300. In other embodiments (not shown), the masonry blocks may be vertically aligned with one another, with each masonry block (other than those in the top and bottom course) supporting and supported by one other masonry block. This latter design is less common, and imposes certain restrictions on design and construction.

The walls 340, 440, 540 each comprise respective edge portions 344, 444, 544 and intermediate portions 346, 446, 546 between the edge portions. In general, the edge portions 344, 444, 544 correspond to the critical regions of the respective wall 340, 440, 540 at which the grouted cells are prone to crushing due to high levels of compressive stress. In each of the walls 340, 440, 540, the intermediate portions 346, 446, 546 are composed of the unreinforced masonry blocks 300 and the edge portions 344, 444, 544 are composed of the self-reinforced masonry blocks 100B, 100C. The walls 340, 440, 540 also comprise respective transition regions 349, 449, 549 in which the unreinforced masonry blocks 300 and the self-reinforced masonry blocks 100B overlap. Optionally, instead of using the self-reinforced masonry blocks 100B in which both cells 106B are reinforced, the self-reinforced masonry blocks that straddle the edge portions 344, 444, 544 and the transition regions 349, 449, 549 may have only one confining reinforcement reinforcing only one cell, with the cell that overlaps the unreinforced masonry blocks 300 being unreinforced.

Reference is now made specifically to FIG. 3. The wall 340 shown in FIG. 3 is a solid reinforced masonry shear wall, in which the edge portions 344 constructed from self-reinforced masonry blocks 100B, 100C are the two opposed vertically extending ends of the wall 340 and the rest of the wall, that is, the intermediate portion 346 between the edge portions 344, is constructed using unreinforced masonry blocks 300.

Referring now to FIG. 4, the wall 440 shown therein is a masonry shear wall having an opening 452 defined therein. In the wall 440, the edge portions 444 constructed from self-reinforced masonry blocks 100B, 100C include not only the two opposed vertically extending ends of the wall 440, but also the vertically extending portions of the wall 440 adjacent the opening 452 therein, both alongside the opening 452 and in the region extending from the bottom of the opening 452 to the base of the wall 440. The remainder of the wall 440 is constructed using unreinforced masonry blocks 300.

FIG. 5 shows another masonry shear wall 540 having an opening 552 defined therein. The wall 540 is suitable for situations in which significantly high compressive strains are expected, and the edge portions 544 comprise the portions of the wall 540 extending between the ends thereof and the opening 552, with the portion of the wall 540 beneath the opening being constructed from unreinforced masonry blocks 300.

In the exemplary walls 340, 440, 540 shown in FIGS. 3, 4, and 5, respectively, the self-reinforced masonry blocks 100B, 100C extend along the entire height of the wall 340, 440, 540 for the edge portions 344, 444, 544. Depending on the applied loading and design requirements, in alternate embodiments self-reinforced masonry blocks according to aspects of the present invention may be used only for base regions of the edge portions, that is, a vertically continuous set of courses extending upwardly from the base of the wall where the need for ductility and energy dissipation exist, but only extending part of the height of the wall 340, 440, 540. Self-reinforced masonry blocks having two confining reinforcements, i.e. one for each cell, may also be used in flanges of shear walls to create higher ductility for different cross-sectional shapes of shear walls.

As noted above, the respective cells 108A, 108C, 308 of vertically adjacent masonry blocks 100B, 100C, 300 are in registration with one another to define vertically extending tubular cavities 342A, 342B (FIG. 3), 442A, 442B (FIG. 4) and 542A (FIG. 5) which are shown in broken lines. In order to avoid unduly cluttered drawings, not all of the tubular cavities are shown. The vertically extending tubular cavities in the edge portions 344, 444, 544 of the walls 340, 440, 540 are denoted, respectively, by reference numerals 342A, 442A and 542A, and the vertically extending tubular cavities in the intermediate portions 346 of the wall 340 and transitional portions 449 of the walls 440 are denoted, respectively, by reference numerals 342B and 442B. At least some of the vertically extending tubular cavities 342B, 442B in the intermediate portions 346 (FIG. 3) and in the transitional portions 449 (FIG. 4) are filled with grout 348 and have a resilient reinforcement member 350, such as a steel bar, extending vertically therethrough and embedded in the grout 348. In order to avoid unduly cluttered drawings, not all of the grout 348 is marked with a reference numeral. All of the outermost vertically extending tubular cavities 342A, 442A, 542A in the edge portions 344, 444, 544 are filled with grout 348 and have a resilient reinforcement member 350 extending vertically therethrough and embedded in the grout 348. For example, in FIG. 5 the vertically extending tubular cavities 342A, 442A, 542A adjacent the ends of the wall 500 and adjacent the opening 552 are filled with grout 548 and have a resilient reinforcement member 350 extending vertically therethrough and embedded in the grout 348. Buckling of the resilient reinforcement members 350 extending through the tubular cavities 342A, 442A, 542A in the edge portions 344, 444, 544 is resisted by the lateral support provided by the self-reinforced masonry blocks 100B, 100C.

Reference is now made to FIGS. 6A to 6E, which are simplified schematic representations illustrating an exemplary method for making a self-reinforced concrete block according to an aspect of the invention, and shows the relative positioning of components used in implementing the exemplary method. The method of FIGS. 6A to 6E may be carried out, for example, following suitable adaptation of conventional equipment and facilities (not shown) used to manufacture conventional unreinforced concrete blocks.

Figure 6A:
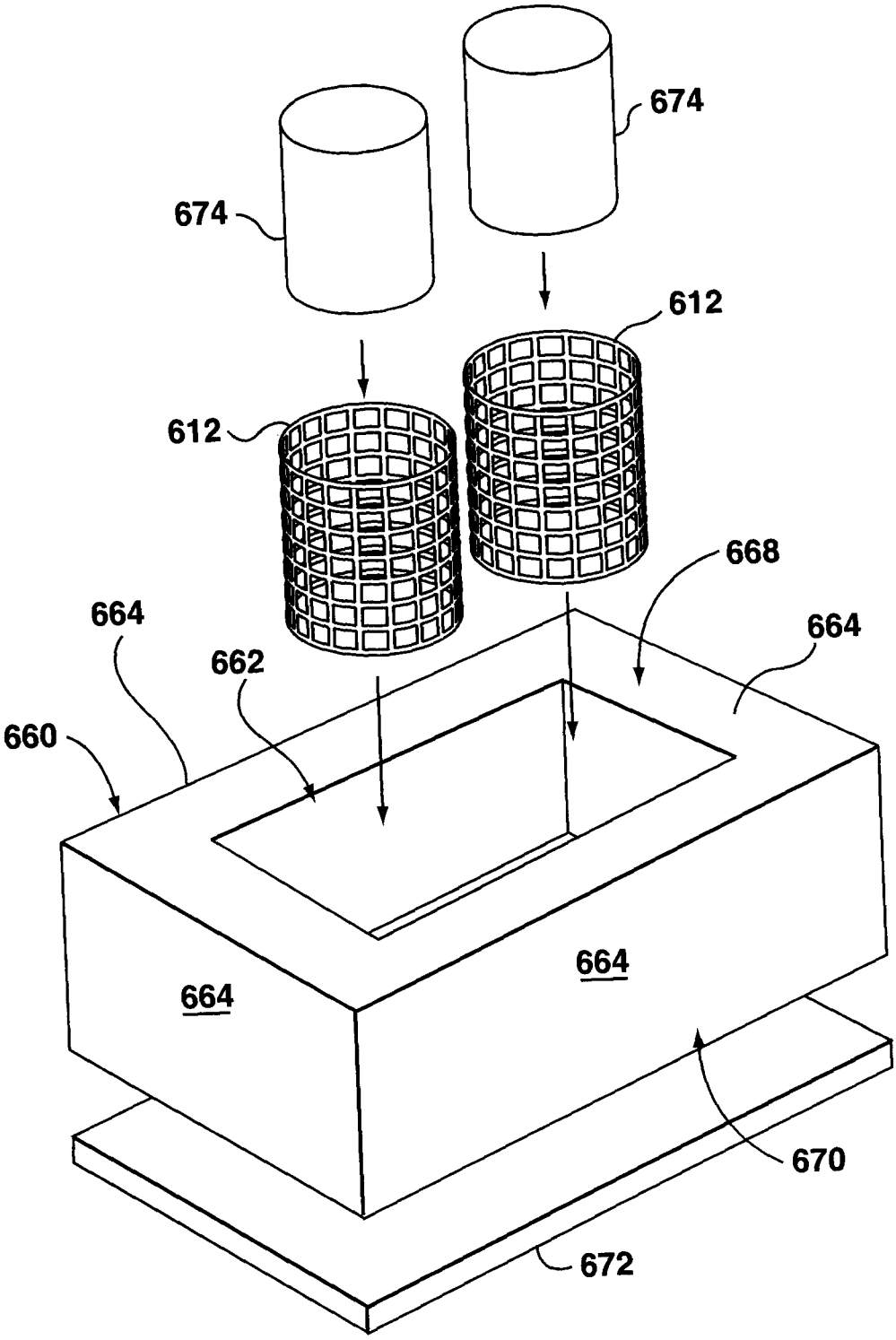
FIGS. 6A to 6E show a method for making self-reinforced masonry blocks according to an aspect of the present invention.

As shown in FIG. 6A, a block mold 660 having a main cavity 662 is provided. The shape of the main cavity 662 corresponds to the intended shape of the self-reinforced concrete block to be produced. The block mold 660 has four side walls 664 that define the main cavity 660, and has an open top 668 and open bottom 670, and a removable base 672 provides the lower surface of the main cavity 662. Continuing to refer to FIG. 6A, two hollow confining reinforcements 612 are placed inside the main cavity 662, inwardly of the side walls 664 of the main cavity 662. In other embodiments, only a single confining reinforcement 612 may be placed in the main cavity 662, for example to form a self-reinforced masonry block having only a single confining reinforcement.

Figure 6B:
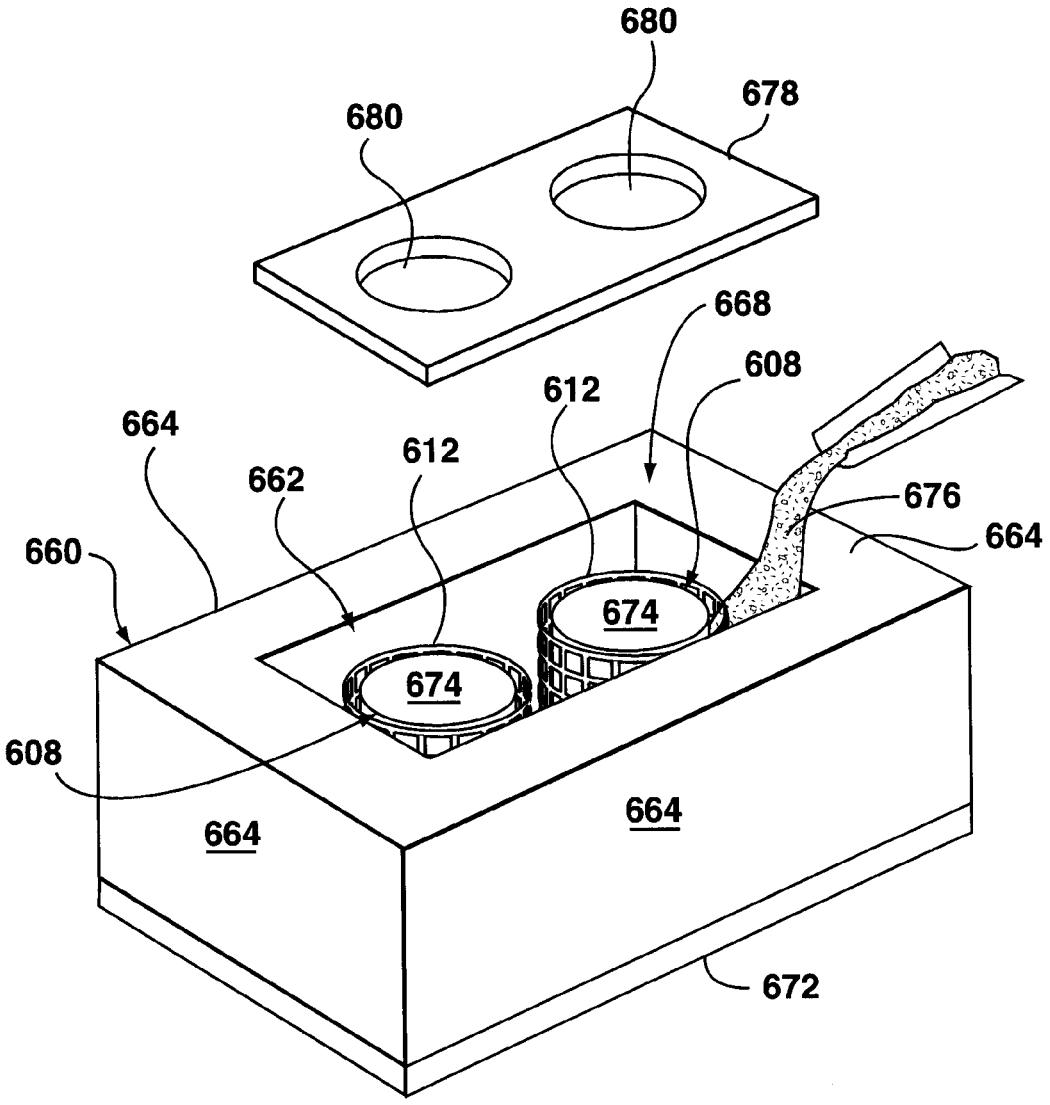

The confining reinforcements 612 are positioned to surround corresponding cell regions 608 (FIG. 6B) which, in the illustrated embodiment, are defined by cell mold elements 674 which are also placed inside the main cavity 662, inwardly of side walls 664. The confining reinforcements 612 and cell mold elements 674 are arranged so that for each confining reinforcement 612, a corresponding one of the cell mold elements 674 is disposed inside and inwardly spaced from that confining reinforcement 612, as shown in FIG. 6B. In one embodiment, the confining reinforcements 612 are placed inside the main cavity 662 after the cell mold elements 674 are placed inside the main cavity 662. In other embodiments, the confining reinforcements 612 may be placed inside the main cavity 662 before the cell mold elements 674 are placed inside the main cavity 662 or simultaneously with the cell mold elements 674.

Referring now to FIG. 6B, once the confining reinforcements 612 and the cell mold elements 674 have been positioned, no-slump concrete mix 676 is introduced into the main cavity 662 to fill the main cavity 662. The cell mold elements 674 inhibit the concrete mix 676 from flowing into the cell regions 608 defined by the cell mold elements 674, leaving the cell regions 608 within the main cavity 662 substantially devoid of concrete 676.

Figure 6C:
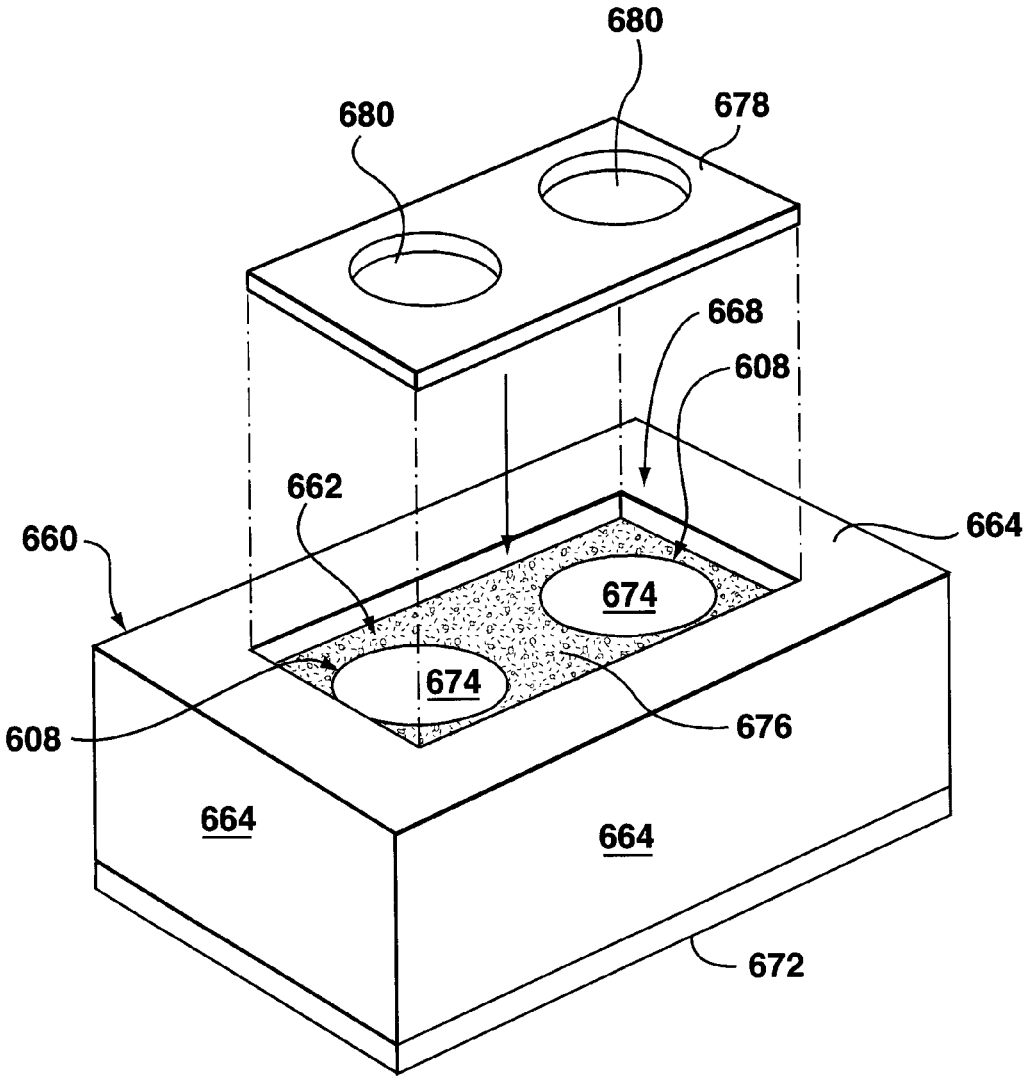
Figure 6D:
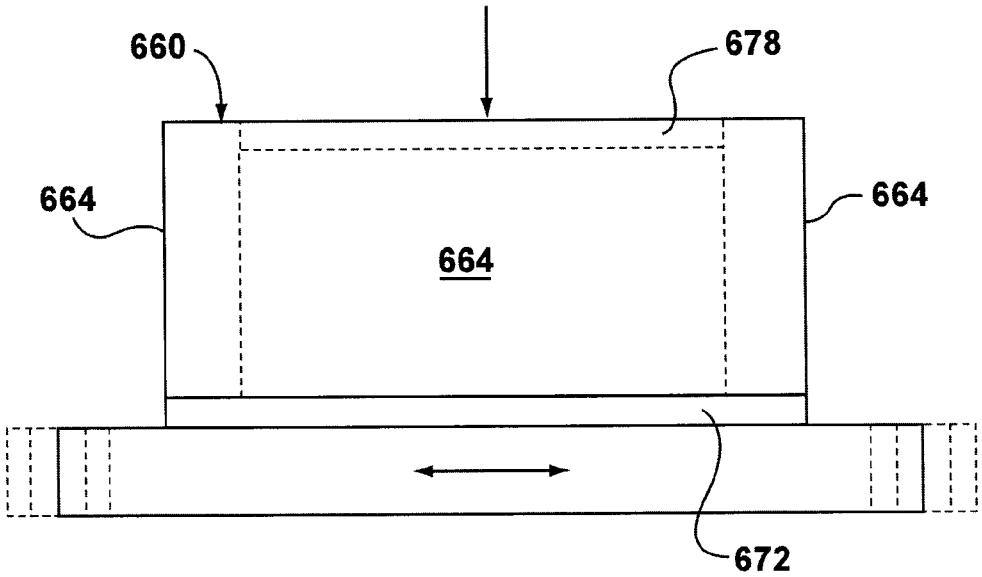

Referring now to FIG. 6C, the block mold 660 is closed by fitting a lid or "shoe" 678 into the main cavity 662, between the side walls 664 to rest atop the concrete mix 676. The shoe 678 has apertures 680 defined therethrough to accommodate the tops of the cell mold elements 674. As shown in FIG. 6D, the shoe 678 is pressed downwardly against the concrete mix 676, for example by a hydraulic apparatus (not shown), to apply compression to the concrete mix 676, and the block mold 660, base 672 and shoe 678 are vibrated as a single unit to compact the concrete mix 676 into a hardened shape and thereby form a self-reinforced concrete block 600. Then, as shown in FIG. 6E, the base 672 can be lowered away from the block mold 660 to release the self-reinforced concrete block 600.

FIGS. 6A to 6E are illustrative only, and do not imply that the confining reinforcements 612 must be placed in the block mold 660 through the open top 668; the confining reinforcements 612 may be placed in the block mold 660 through the open bottom 670. In a typical manufacturing operation, the cell mold elements 674 are fastened into the block mold 660, and the base 672 is raised into position to provide the lower surface of the main cavity 662. The concrete mix 676 is placed in the main cavity 662 and then the shoe 678 is lowered to close the block mold 660. For example, the shoe 678 may have a recess or aperture (not shown) to accommodate a support (not shown) that secures the cell mold elements 674 to the block mold 660, as is known in the art. The shoe 678 applies pressure as the mold assembly is vibrated. The base 672 is then lowered and, with the help of the shoe 678, the freshly produced self-reinforced concrete block 600 is forced to stay on the base 672 as the base 672 is lowered away from the block mold 660. The base 672 and finished block are moved away, for example by conveyor belt (not shown), and a new base 672 is moved into position to form another self-reinforced concrete block 600. During this process, the confining reinforcements 612 could, for example, be positioned on the base 672 before the base 672 is raised into position to provide the lower surface of the main cavity 662 or the confining reinforcements 612 could be positioned to surround the cell mold elements 674 before the base 672 is raised.

With the use of no-slump concrete which essentially does not flow, where the confining reinforcement is porous, that is, has a plurality of apertures therethrough, the thickness of the confining reinforcement must be limited so that the vibration and compacting pressure can force the concrete mix to fill the apertures and any space between the confining reinforcement and the stacking surfaces. For example, with a mesh confining reinforcement, use of circumferentially extending elements that are too thick may result in voids under those circumferentially extending elements, which would weaken the concrete and reduce the confining effects.

Figure 6E:
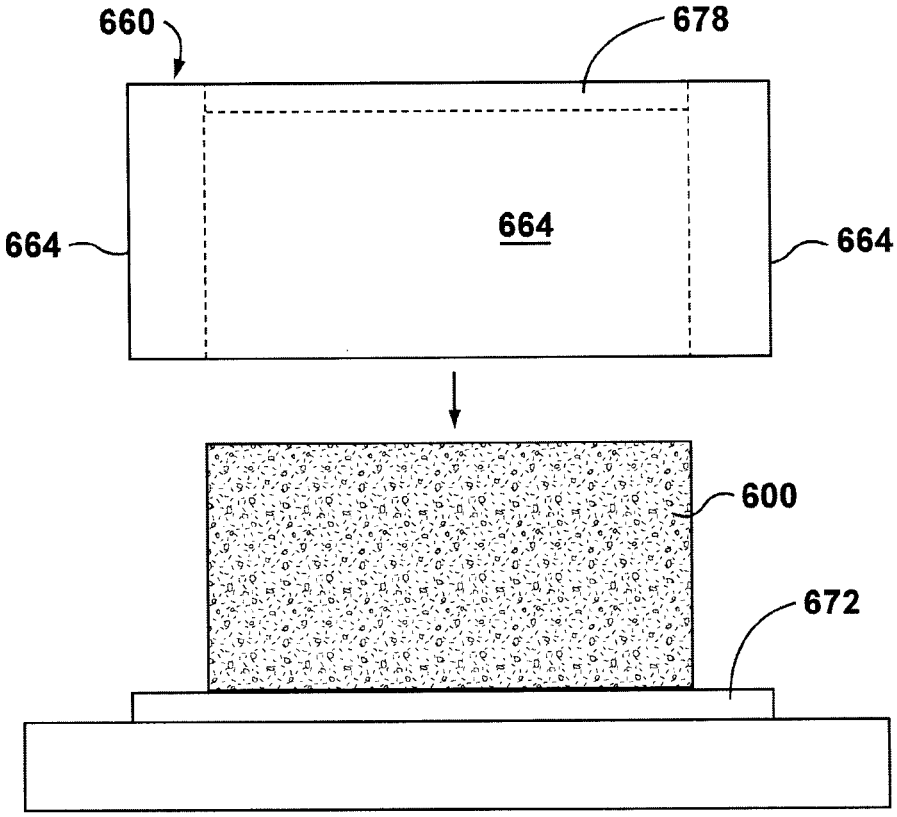

The confining reinforcement should provide sufficient vertical stiffness to prevent any substantial rebound effect as the compaction pressure is released at the end of the manufacturing cycle (FIG. 6E). At the same time, the vertical section of the confining reinforcement should also be selected so that, when the concrete in the self-reinforced masonry block in which the confining reinforcement is embedded undergoes compression, for example as part of a concrete shear wall, the confining reinforcement will not undergo any substantial expansion of its horizontal components due to Poisson's effect as the vertical components of the confining reinforcement are compressed. Such horizontal or lateral expansion would reduce the confining effect of the confining reinforcement on the grout and concrete surrounded thereby. The use of porous confining reinforcements is preferred because it assists in preventing vertical compression of the confining reinforcement from causing lateral expansion thereof, and the apertures in the confining reinforcement also permit the development of a bond between the concrete inside and outside of the confining reinforcement, which inhibits premature separation of the concrete outside the confining reinforcements from the concrete contained within the confining reinforcements.

As noted above, the size and external geometry of self-reinforced masonry blocks according to aspects of the present invention are preferably the same as those of commonly used conventional unreinforced concrete masonry blocks. In a preferred embodiment, the size and shape of the cells, such as cells 108A, 108B, 108C differ from the size and shape of the cells of common unreinforced concrete masonry blocks. As shown in FIG. 3, the cross-sectional shape of the cells 308 of conventional unreinforced concrete masonry blocks 300 is generally square, whereas the cross-sectional shape of the cells 106B, 106C in the exemplary self-reinforced masonry blocks 100B, 100C is generally circular. The circular cells 106B, 106C in the exemplary self-reinforced masonry blocks 100B, 100C are somewhat smaller than the square cells 308 of the conventional unreinforced concrete masonry blocks 300, even for the same cell width. The result of this size difference is that less grout 348 is required to fill the circular cells 106B, 106C in the exemplary self-reinforced masonry blocks 100B, 100C than is required to fill the square cells 308 of the conventional unreinforced concrete masonry blocks 300. Since the grout 348 is generally weaker than the concrete from which the masonry blocks are formed, the structure formed by the grout-filled self-reinforced masonry blocks 100B, 100C will have greater compressive strength than an otherwise equivalent structure formed by grout-filled unreinforced masonry blocks 300. Without being limited by theory, this improved compressive strength is believed to arise independently of the confining reinforcement, but also enhances the effectiveness of the confining reinforcement more effective by improving the strength of the concrete and grout enclosed within the confining reinforcement.

One or more currently preferred embodiments have been described by way of example. It will be apparent to persons skilled in the art that a number of variations and modifications can be made without departing from the scope of the invention as defined in the claims.

What is claimed is:

1. A self-reinforced masonry block, comprising:

a main body having opposed substantially parallel stacking surfaces;

the main body having at least one tubular cell defined therethrough from one of the stacking surfaces to the other stacking surface;

each at least one cell having a longitudinal axis and a longitudinal length defined by the stacking surfaces;

at least one hollow confining reinforcement embedded in the main body;

each confining reinforcement surrounding a corresponding one of the at least one cell along the longitudinal length thereof;

each confining reinforcement extending substantially entirely along the longitudinal length of the cell surrounded by said confining reinforcement;

each confining reinforcement terminating inwardly of the stacking surfaces;

wherein the main body is composed of no-slump concrete; and wherein each confining reinforcement comprises at least one of (a) a metal sheet formed into a tube having perforations therein and (b) a mesh material.

2. The self-reinforced masonry block of claim 1 wherein each confining reinforcement is spaced outwardly from the cell surrounded by said confining reinforcement.

3. The self-reinforced masonry block of claim 1, wherein each confining reinforcement comprises a material selected from the group consisting of cold formed steel, hot-rolled steel, aluminum, glass, carbon fiber composites and fiber reinforced polymer.

4. The self-reinforced masonry block of claim 1, wherein each confining reinforcement is tubular.

5. The self-reinforced masonry block of claim 4 wherein each cell and each confining reinforcement is substantially circular in cross-section.

6. The self-reinforced masonry block of claim 4 wherein each cell and each confining reinforcement is substantially square in cross-section.

7. A wall, comprising:

a plurality of the self-reinforced masonry blocks of claim 1; and a plurality of unreinforced masonry blocks;

each of the unreinforced masonry blocks comprising:

a main body having opposed substantially parallel stacking surfaces;

the main body having at least one tubular cell defined therethrough from one of the stacking surfaces to the other stacking surface;

each at least one cell having a longitudinal axis and a longitudinal length defined by the stacking surfaces;

the wall comprising edge portions and intermediate portions between the edge portions, wherein:

both the self-reinforced masonry blocks and the unreinforced masonry blocks are arranged in a stacked configuration wherein the cells of vertically adjacent masonry blocks are in registration with one another to define vertically extending tubular cavities;

wherein:

the intermediate portions comprise the unreinforced masonry blocks;

at least base regions of the edge portions are composed of the self-reinforced masonry blocks; and all outermost vertically extending tubular cavities in the edge portions are filled with grout and have a resilient reinforcement member extending vertically therethrough and are embedded in the grout.

8. The wall of claim 7, wherein at least one of the vertically extending tubular cavities in the intermediate portions are filled with grout and have the resilient reinforcement member extending vertically therethrough and are embedded in the grout.

9. The wall of claim 7 wherein each confining reinforcement is spaced outwardly from the cell surrounded by said confining reinforcement.

10. The wall of claim 7, wherein the self-reinforced masonry blocks and the unreinforced masonry blocks are concrete blocks.

11. The wall of claim 7, further comprising mortar disposed between the stacking surfaces of vertically adjacent masonry blocks.

12. The wall of claim 7, wherein the edge portions comprise opposed vertically extending ends of the wall.

13. The wall of claim 12, wherein the edge portions further comprise vertically extending portions of the wall adjacent an opening therein.

* * * * *